US005174223A

United States Patent [19]

Nagy et al.

[11] Patent Number: 5,174,223

[45] Date of Patent: Dec. 29, 1992

[54] ERGONOMICALLY DESIGNED COMPUTER WORKSTATION ADJUSTABLE TO VARIOUS SITTING AND STANDING POSITIONS

[76] Inventors: Marta K. Nagy, 3578 Agate St., Thousand Oaks, Calif. 91360; Victor G. Foris, 4608 Glencoe Ave. #6, Marina Del Rey, Calif. 90292

[21] Appl. No.: 768,458

[22] Filed: Sep. 30, 1991

Related U.S. Application Data

[63] Continuation of Ser. No. 529,495, May 29, 1990, abandoned, which is a continuation-in-part of Ser. No. 409,733, Sep. 20, 1989, abandoned.

[51] Int. Cl.[5] ..... A47B 35/00

[52] U.S. Cl. ..... 108/50; 108/144; 312/206

[58] Field of Search ..... 108/144, 6, 50, 146; 312/114, 208, 206, 312, 247, 235.6, 298, 194, 196; 248/917, 918, 920, 922, 923

[56] References Cited

U.S. PATENT DOCUMENTS

| | | | |
|---|---|---|---|
| 1,652,774 | 12/1927 | Fraser et al. | 312/233 |
| 4,515,086 | 5/1985 | Kniencinski et al. | 312/196 X |
| 4,576,424 | 3/1986 | Nelson | 312/231 |
| 4,635,565 | 1/1987 | Novak | 108/147 |
| 4,664,039 | 5/1987 | Schneider | 108/9 X |
| 4,688,862 | 8/1987 | Fowler et al. | 312/196 X |
| 4,755,009 | 7/1988 | Price et al. | 248/188.5 X |
| 4,779,922 | 10/1988 | Cooper | 248/918 X |
| 4,805,538 | 2/1989 | Fisher et al. | 108/147 X |
| 4,920,458 | 11/1990 | Jones | 312/7.2 X |

*Primary Examiner*—Jose V. Chen

[57] ABSTRACT

An ergonomically designed computer workstation includes a computer stand, stool, footrest assembly, and keyboard and forearm support assembly being adjustable so that the workstation can accommodate users in various sitting and standing positions. The stand has a base member, an upright member supported by the base member for vertical movement, and a planar platform mounted by the upright member in a horizontal plane to provide a support surface for a variety of computer equipment. The stool includes a stationary base and a seat with a back for supporting a user thereon. The stool can be adjusted to vertically move the seat away from or toward the base to position the seat at a desired elevation. The footrest assembly is mounted to the base member of the stand and can be adjusted to and positioned at a desired elevation corresponding to the desired elevation selected for the stand platform and stool in order to permit the user to assume an ergonomically proper position at the stand and on the stool. The keyboard and forearm support assembly is mounted within a cutout region of the stand platform and adjustable in selected angular and height positions for supporting a computer keyboard and a user's forearms and wrists at a selected one of a range of angles of inclination and selected height relative to a horizontal plane. A soft elbow support pad is mounted along an edge of the support assembly.

7 Claims, 7 Drawing Sheets

ERGONOMICALLY DESIGNED COMPUTER WORKSTATION ADJUSTABLE TO VARIOUS SITTING AND STANDING POSITIONS

CROSS REFERENCE TO RELATED APPLICATION

This application is a continuation of application Ser. No. 07/529,495, filed May 29, 1990, now abandoned, which is a continuation-in-part of copending U.S. patent application Ser. No. 409,733, filed Sep. 20, 1989, now abandoned. This application also is related to a copending application by the same inventor entitled "Ergonomically Designed Keyboard and Forearm Support Assembly For a Computer Workstation", assigned U.S. Ser. No. 07/768,331, filed Sep. 30, 1991.

DESCRIPTION

Background of the Invention

The present invention generally relates to computer workstation furniture and, more particularly, to an ergonomically designed keyboard and forearm support assembly for a computer workstation.

Today, major physical problems are experienced by persons who work on computes. These physical problems can be categorized as neck pain and stiffness, low back pain and stiffness, and strain of the wrists. These problems are caused by chairs, computer desks, and keyboard support stands that are unsuitable for the particular computer user. Typically, computer users have to take five minutes or so for each 30 to 60 minutes of working time to move about to relieve their neck, back and wrist pain symptoms. As a result, user productivity suffers and employee claims for workman's compensation injuries increase.

The comfort and well-being of users of computers have become concerns of growing importance. The term "ergonomics" applies to design efforts which seek to adapt working conditions and equipment design and operation to accommodate the physical needs and capabilities of users. Various attempts able computer display terminals, keyboards, and workstations. Representative of the prior art attempts are the designs disclosed in U.S. Pat. Nos. to Kwiecinski et al (4,515,086), Latino et al (4,545,554), Wilder (4,560,132), Lake, Jr., et al (4,565,343), Brown (4,638,969), Fowler et al (4,688,862), LaBudde et al (4,709,972), Hillary et al (4,729,533), and Mitchell et al (4,832,419). While these prior art designs appear to be steps in the right direction, they fail to provide a design having the breadth and depth needed to adequately address the sources and causes of the above-described user problems.

Consequently, a need exists for an ergonomically designed computer workstation which will substantially reduce, if not eliminate entirely, the sources and causes of these severe physical problems encountered by persons who use computers for several hours each working day.

SUMMARY OF THE INVENTION

The present invention provides a computer workstation ergonomically designed to satisfy the aforementioned needs. The ergonomic computer workstation incorporates a computer stand, stool, footrest assembly, and keyboard and forearm support assembly which are all adjustable for permitting the workstation to accommodate different users in various sitting and standing positions. These features are most advantageously incorporated together in the same computer workstation to fully realize all potential benefits deriving therefrom, such as significantly improved user productivity and amelioration of work-related orthopedic problems. However, it should be recognized that the advantages of individual ones of the features can be enjoyed separately in different workstations.

Furthermore, only the computer stand incorporating the keyboard and forearm support assembly comprises the invention herein. However, all features are disclosed herein for providing a complete and thorough understanding of the overall workstation.

Accordingly, the present invention is directed to an ergonomically designed computer workstation having a computer stand with an adjustable keyboard and forearm support assembly. The keyboard and forearm support assembly comprises: (a) a mounting frame for attachment to a table platform for supporting a computer; and (b) a support frame for supporting a computer keyboard and a user's forearms and being releasably mounted to the mounting frame for placement at a selected one of a range of angles of inclination relative to a horizontal plane; and (c) means for adjustably coupling the support frame to the mounting frame for releasably securing the support frame to the mounting frame at the selected one angle of inclination.

More particularly, the support frame includes an inner platform portion for supporting a computer keyboard, an outer platform portion for supporting a user's forearms, and a middle wall interconnecting the inner and outer platform portions and offsetting the inner platform portion from the outer platform. The middle wall rigidly interconnects and offsets and disposed the inner and outer platform portions such that they extend in generally parallel planes. The support assembly also includes an elongated elbow support pad mounted along an edge of the outer platform portion.

These and other features and advantages of the present invention will become apparent to those skilled in the art upon a reading of the following detailed description when taken in conjunction with the drawings wherein there is shown and described an illustrate embodiment of the invention.

BRIEF DESCRIPTION OF THE DRAWINGS

In the course of the following detailed description, reference will be made to the attached drawings in which.

DETAILED DESCRIPTION OF THE INVENTION ERGONOMICALLY DESIGNED COMPUTER WORKSTATION

Figure 2:
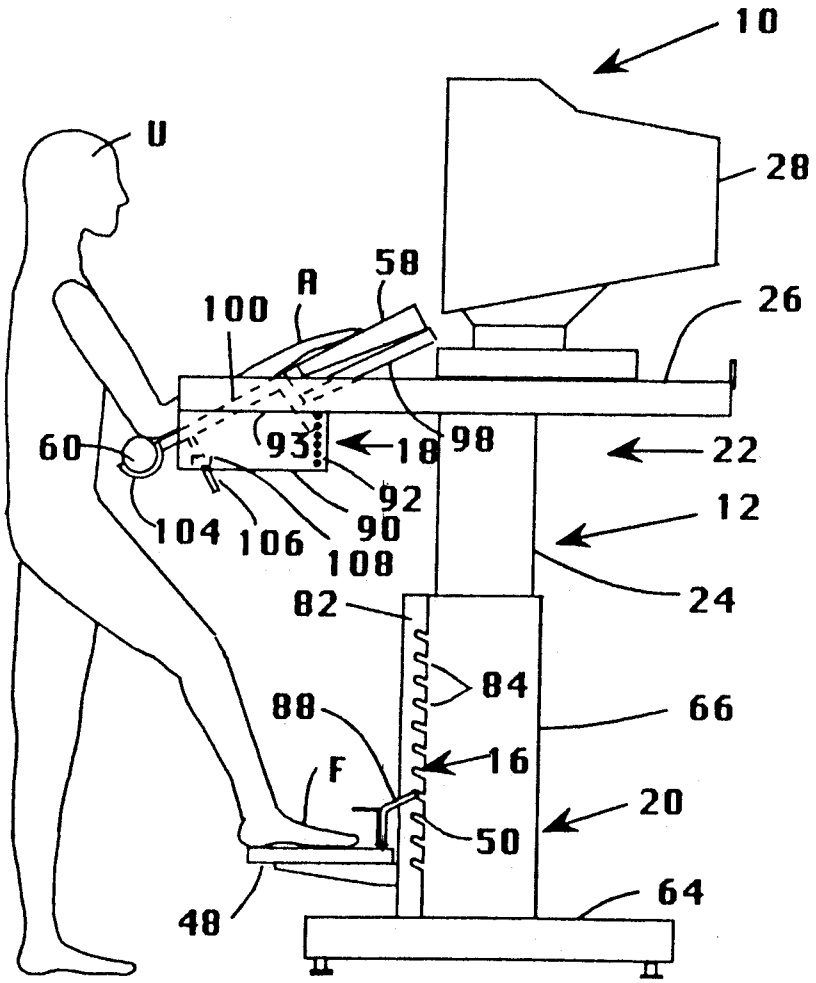
FIG. 2 is another side elevational view of the computer workstation of FIG. 1, the workstation being illustrated adjusted for a user working in an ergonomically correct standing position.
Figure 1:
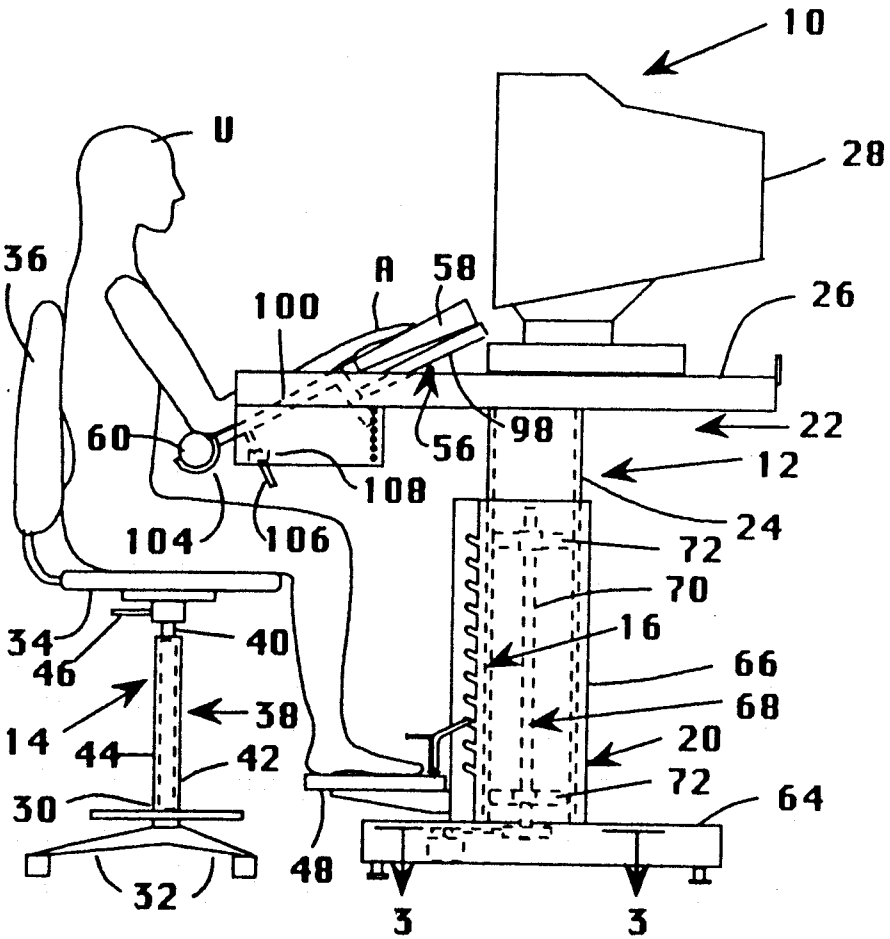
FIG. 1 is a side elevational view of an ergonomically designed computer workstation incorporating a computer stand and stool and a footrest assembly which constitute features of the invention of the related cross-reference application, and a keyboard and forearm support assembly which constitute the present invention, the workstation being illustrated adjusted for a user working in an ergonomically correct sitting position.

Referring now to the drawings, and particularly to FIGS. 1 and 2, there is shown an ergonomically designed computer workstation, generally designated 10. The workstation 10 basically incorporates a computer stand 12, a stool 14, a footrest assembly 16, and a keyboard and forearm support assembly 18. All of these features are independently adjustable for permitting the workstation 10 to be tailored to accommodate different users in various sitting and standing positions.

All features but the keyboard and forearm support assembly 18 of the workstation 10 constitute features of the invention of the related application cross-referenced above. The keyboard and forearm support assembly 18 is a feature which constitutes the present invention. However, all features are described and illustrated herein for the sake of providing a complete and thorough understanding of the overall makeup of the computer workstation 10.

The computer stand 12 of the workstation 10 includes a base member 20 adapted to rest at a stationary position on a supportive surface, such as a floor of a room in an office building or home. The stand 12 also includes computer supporting means 22 in the form of a movable member 24 mounted upon the base member 20 for movement in a generally vertical direction, and a platform 26 of generally planar configuration mounted by the movable member 24 in a generally horizontal plane for supporting a variety of computer equipment 28 thereon. The platform 26 is supported in a fixed relation to the movable member 24 for movement in the vertical direction along with the movement of the movable member 24.

Figure 4:
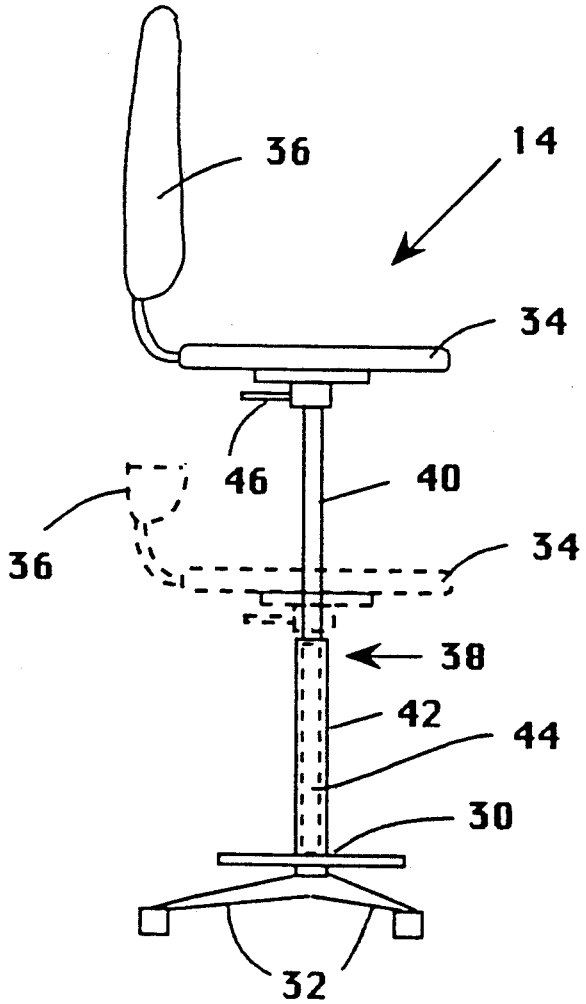
FIG. 4 is a side elevational view of the stool employed with the workstation of FIG. 1.

Referring to FIGS. 1, 2 and 4, the stool 14 of the computer workstation 10 includes a base 30 with a plurality of legs 32 for resting in a stationary position on the floor and a seat 34 having a back 36 for supporting a user U thereon. The stool 14 also includes actuation means 38 interconnecting the base 30 and seat 34 in the form of an elongated hollow shaft 40 rigidly mounted to and extending downwardly from the seat 34 and a hollow cylinder 42 rigidly mounted to and extending upwardly from the base 30. The hollow shaft 40 is inserted and movably mounted in a telescoping fashion in the cylinder 42.

The actuation means 38 of the stool 14 also includes a pneumatic pressure mechanism 44 housed in the cylinder 42 and communicating with the shaft 40 and having a manual actuating lever 46 extending laterally from the top of the hollow shaft 40. The lever 46 is selectively manually operable for actuating the pneumatic pressure mechanism 44 to cause extension or retraction of the shaft 40 from or into to the cylinder 42 and thereby generally vertical movement the seat 34 away from or toward the base 30 to position the seat 34 at a desired elevation above the surface supporting the base 30. For example, the stool 14 of the workstation 10 is adjustable between the sitting and standing positions of the user shown in FIGS. 1 and 2 and also between a fully retracted, or lowered, position, as seen in dashed line form in FIG. 4 and a fully extended, or elevated, position, as seen in solid line form in FIG. 4. In order to provide a stool that can accommodate a user in a sitting position and a standing position over the range of short to tall persons, the length of travel of the stool used in the system of the invention is at least 4 inches longer, preferably 5–7 inches longer than a standard adjustable stool or bar stool.

Figure 5:
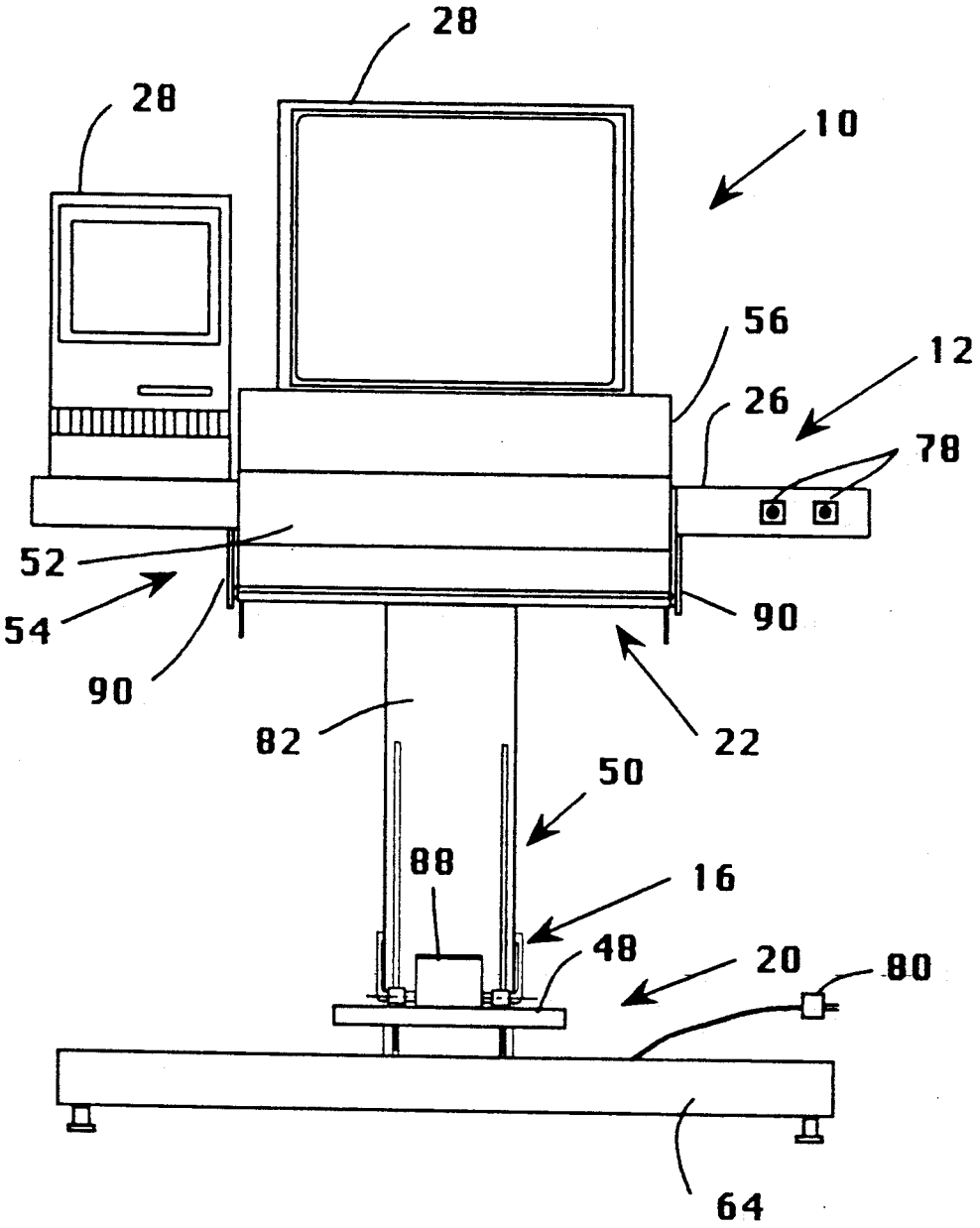
FIG. 5 is a front elevational view of the computer workstation of FIG. 1.
Figure 6:
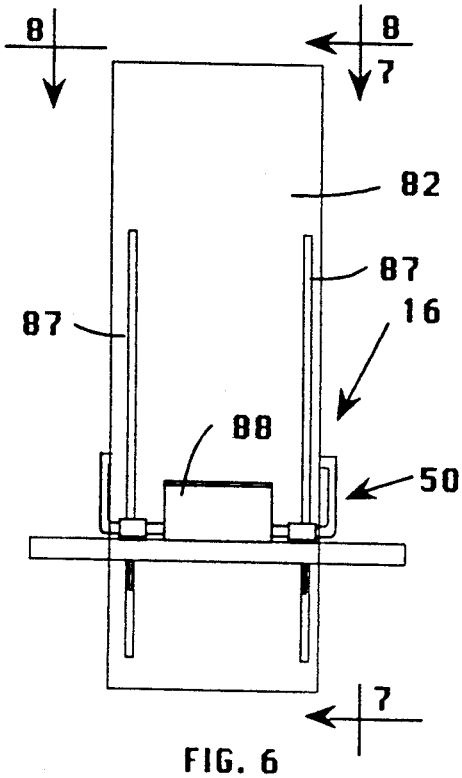
FIG. 6 is an enlarged front elevational view of the adjustable footrest assembly of the workstation of FIG. 5.
Figure 7:
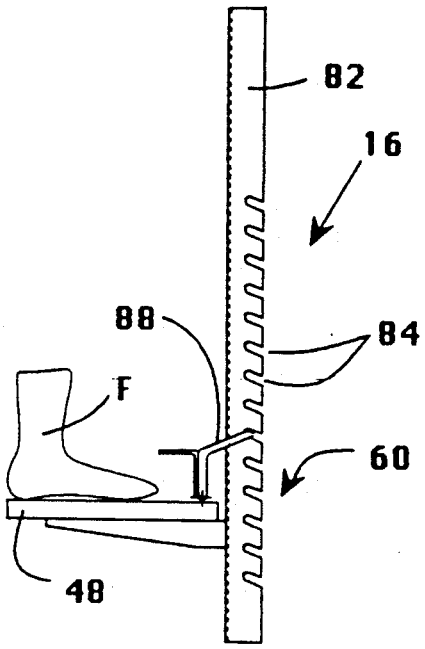
FIG. 7 is a side elevational view of the footrest assembly as seen along line 7—7 of FIG. 6.
Figure 8:
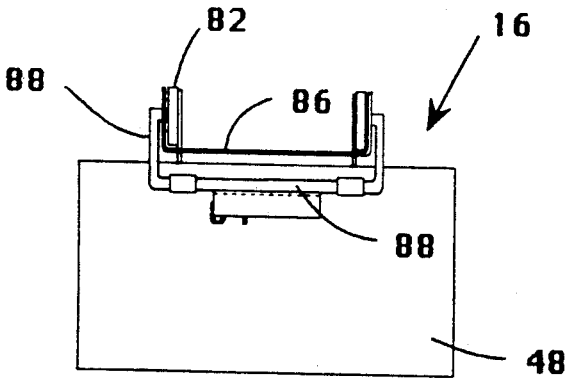
FIG. 8 is a top plan view of the footrest assembly as seen along line 8—8 of FIG. 6.
Figure 9:
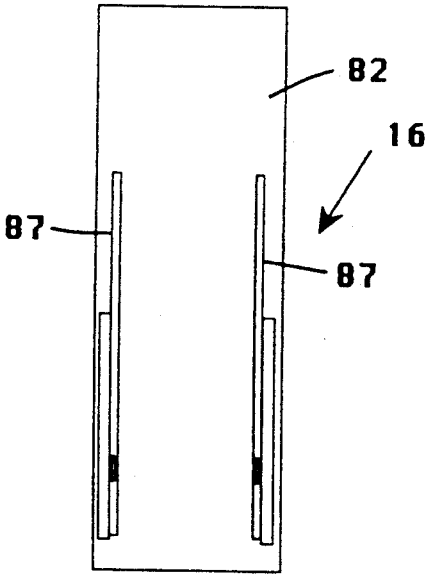
FIG. 9 is a rear elevational view, on a reduced scale, of the adjustable footrest assembly of FIG. 6.
Figure 10:
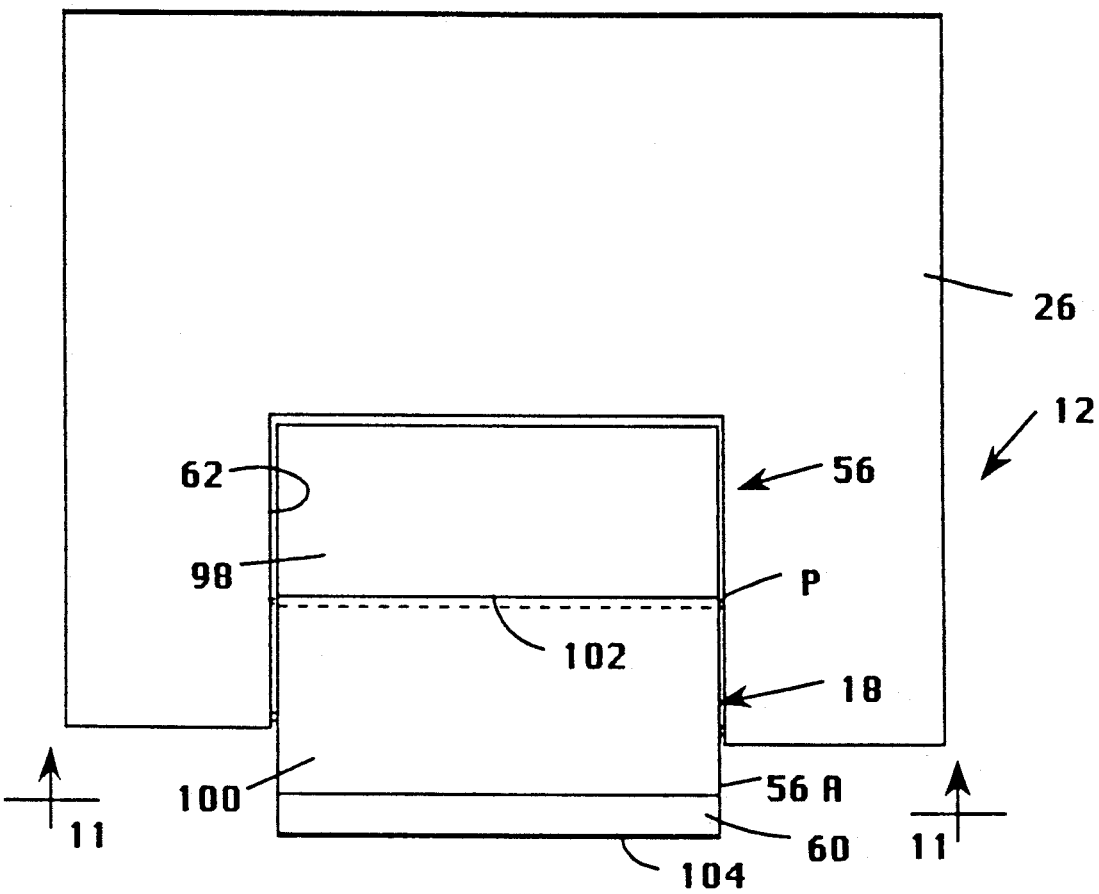
FIG. 10 is an enlarged top plan view of a platform of the computer stand and the keyboard and forearm support assembly of the workstation of FIGS. 1 and 2, the keyboard and forearm support assembly being illustrated adjusted to a horizontal position.

Referring to FIGS. 1, 2 and 5, the footrest assembly 16 of the workstation 10 is mounted to the base member 20 of the computer stand 12 and can be adjusted to and positioned at a desired elevation corresponding to the desired elevation selected for the computer stand platform 26 and the stool 14 in order to permit the user U to assume an ergonomically proper position at the stand 12 and on the stool 14. Basically, the footrest assembly 16 includes a footrest member 48 being vertically movable along the stand base member 20, and a ratchet mechanism 50 interconnecting the footrest member 48 and base member 20. The ratchet mechanism 50 is actuatable to place and hold the footrest member 48 at the desired elevation. The weight of the footrest is balanced by counterweights or negator springs, not shown, as are standard in the art.

Referring to FIGS. 1, 2, 5, 10 and 11, the keyboard and forearm support assembly 18 of the workstation 10 is shown mounted within a cutout region 52 of the computer stand platform 26. The support assembly 18 will move in the vertical direction along with the platform 26 and the movable member 24 of the computer stand 12.

Basically, the keyboard and forearm support assembly 18 is attached to a mounting frame 54 by means of link 106 and shaft 110. The side plates 90 of the mounting frame 54 are attached to the computer stand platform 26, an elongated cylindrical-shaped elbow support pad 60 is mounted along an edge 56A of the support frame 56. Means 62 are provided for adjustably coupling the support frame 56 to the mounting frame 54. The support frame 56 is releasably mounted to the mounting frame 54 for placement at a selected one of a range of angles of inclination and a range of selected height positions relative to a horizontal plane. The coupling means 62 can be adjusted and set to releasably secure the support frame 56 to the mounting frame 54 at the elected one angle of inclination and range of selected height positions. The outer platform portion 100 of the support frame 56 supports a computer keyboard 58 and the user's forearm A.

COMPUTER STAND

Referring to FIGS. 1–4, the base member 20 of the computer stand 12 of the workstation 10 basically has a lower base portion 64 resting in a generally horizontal stationary position on the support surface (not shown) and an upright channel portion 66 rigidly mounted on and extending upwardly in generally orthogonal relation from the lower base portion 64. The movable member 24 of the computer stand 12 is an upright support post 24 slidably mounted along the upright channel portion 66 of the base member 20 for movement in a generally vertical direction relative thereto toward and away from the lower base portion 64 of the base member 20. The platform 26 is mounted on the top of the upright post 24 so as to extend in the generally horizontal plane for supporting the computer equipment 28.

Figure 3:
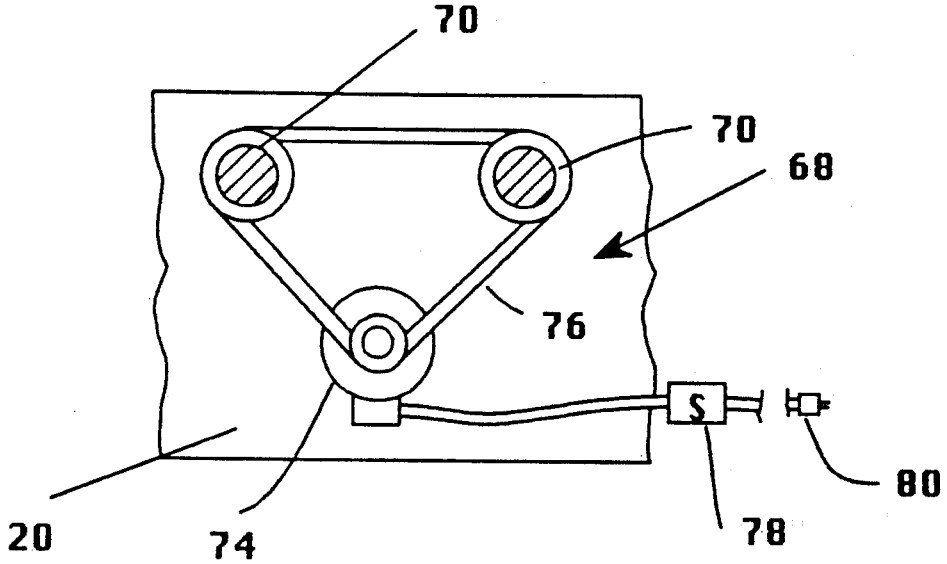
FIG. 3 is a top plan view, partly in section, of a drive mechanism of the computer stand of the workstation of FIG. 1.

Referring to FIGS. 1 and 3, the computer stand 12 also includes drive means 68 interconnecting the movable upright support post 24 and the lower base portion 64 of the base member 20. The drive means 68 are selectively operable for vertically raising and lowering the computer platform 26 relative to the base member 20 to position the computer equipment 28 at a desired elevation above the floor supporting the computer stand 12. The drive means 68 includes at least one or a pair of elongated drive screws 70 drivingly interconnected to the movable upright post 24 of the stand 12 by being threaded through nuts 72 stationarily mounted to the upright post 24. The drive means 68 also includes a motor 74 mounted to the lower base portion 64 of the base member 20 and drivingly coupled to the drive screws 70 by a flexible endless member 76, such as a flexible drive belt. Upon selected operation, the motor 74 will cause rotation of the drive screws 70 in one or the other opposite direction to move the upright post 24 up or down relative to the base member 20.

The drive means 68 also includes a switch 78 mounted on the stand platform 26 and connected between the motor 74 and a source of electrical power provided by inserting a plug 80 into a power outlet (not shown). The switch 78 is manually actuatable for causing operation of the motor 74 to rotate the drive screws 70 in one or the other opposite directions to correspondingly raise or lower the computer stand platform 26.

ADJUSTABLE FOOTREST ASSEMBLY

Referring to FIGS. 1, 2 and 5–9, the footrest assembly 16 is mounted to the upright channel portion 66 of computer stand base member 20. The footrest assembly 16 is adjustable positioning the user's foot or feet F at a desired elevation corresponding to the elevation of the computer stand platform 26. As mentioned earlier, the footrest assembly 16 includes the footrest member 48 and the ratchet mechanism 50. The footrest member 48 is movable vertically along the upright base portion 66. The ratchet mechanism 50 interconnects the footrest member 48 and the upright base portion 66 and can be actuated to place and hold the footrest member 48 at the desired elevation.

More particularly, the ratchet mechanism 50 includes an upright guide track 82 mounted to the upright channel portion 66 of the base member 20. The guide track 82 defines a plurality of generally vertically spaced latch positions in the form of notches 84 along its opposite vertical edges. The ratchet mechanism 50 also includes a U-shaped runner 86 supporting the footrest member 48 and slidably mounted at its opposite ends through laterally-spaced vertically-extending slots 87 formed in the guide track 82 for generally vertical movement therealong. The ratchet mechanism 50 further includes a pedal-type catch lever 88 pivotally mounted to the footrest member 48 and actuatable for engaging and releasing a selected one of the latch notch positions 84 on the guide track 82 for positioning the footrest member 48 at the desired elevation.

The user can use his or her foot to actuate the catch lever 88 by pushing it, against its outward spring bias, toward the guide track 82 to disengage the ends of the catch lever 88 from a given set of notches 84. The weight of the footrest member 48 and runner 86 are balanced by a counterweight system or negator springs (not shown) such that the footrest member 48 can easily be moved up or down once the catch lever 88 is disengaged. Once the desired new elevation of the footrest member 48 is reached, the pushing force on the catch lever 88 is merely released and its outward spring bias then returns it back into engagement with another pair of notches 84 at the new elevation.

KEYBOARD AND FOREARM SUPPORT ASSEMBLY

Referring to FIGS. 1, 2, and 10–13, as mentioned earlier, the keyboard and forearm support assembly 18 basically includes the mounting frame 54 attached to the opposite edges 26A of the platform 26 defining the opposite sides of the cutout region 52 thereof, and the support frame 56 for supporting the computer keyboard 58 and the user's forearms A. The mounting frame 54 includes a pair of opposing plates 90 having respective rows of spaced holes 92 therethrough being aligned in pairs. The top edges 91 of the plates 90 are attached the bottom side edge 93 of the platform 26 suitably by adhesive or screw fasteners.

Figure 14:
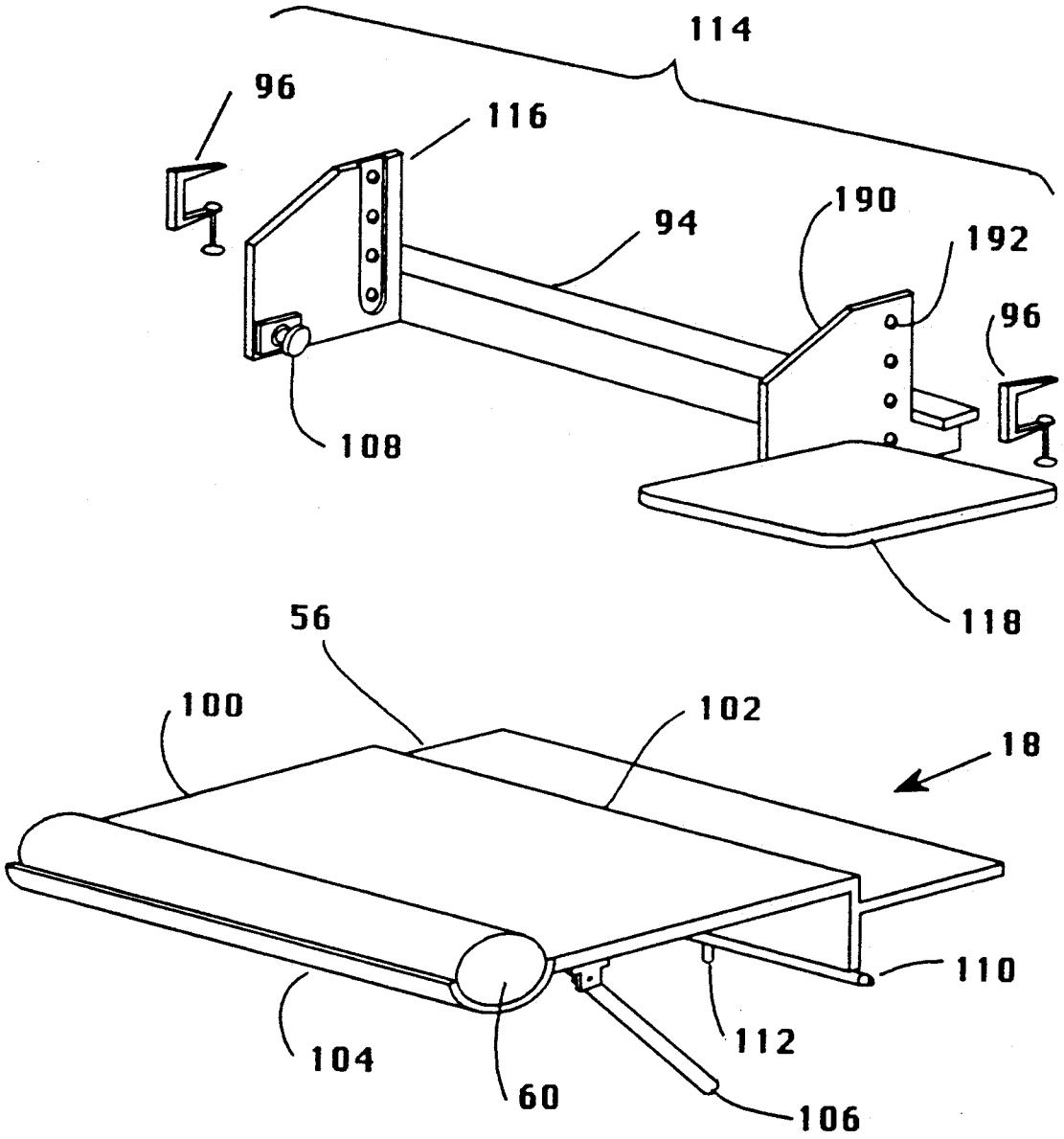
FIG. 14 is an enlarged perspective of an alternate mounting for supporting a keyboard and frame assembly.

As shown in FIG. 14, the mounting frame 114, for the support assembly 18, can be provided in a form where it can be attached to a standard desk or table also. In this form, the mounting frame 114 also includes a brace member 94 extending between and rigidly interconnecting the plates 190. The plates pin holes 190 for receiving pins 110 on the support assembly 18. When attached to the table (not shown) by U-shaped clamps 96, the top surface 116 of the brace member 94 would underlie and interface with the bottom surface of the table. The mounting frame 114 can also include a small platform for supporting a computer mouse, not shown. The platform 118 is attached to the plate 190 by screws depending on whether the computer operator is right-handed or left-handed.

The support frame 54 of the support assembly 18 includes an inner platform portion 98 of generally planar configuration for supporting the computer keyboard 58, an outer platform portion 100 of generally planar configuration for supporting the user's forearms A, and a transversely-extending middle wall 102 rigidly interconnecting the inner and outer platform portions 98, 100 and offsetting the inner platform portion 98 from the outer platform portion 100. The middle wall 102 extends at right angles to, and offsets and disposes, the inner and outer platform portions 98, 100 such that they extend in generally parallel planes with respect to one another and, when the respective platform portions are disposed in parallel horizontal planes, the inner platform portion 98 is disposed at a lower level than the outer platform portion 100. The elongated elbow support pad 60 is mounted along a concave trough 104, such as formed of an extruded material, attached to an edge of the outer platform portion 100.

The offset of the inner platform portion 98 is such that the top of the keyboard 58 is about at the same level as tee outer platform portion 100, as seen in FIGS. 1 and 2. In such relationship, the user's forearms and wrists remain substantially aligned when using the keyboard.

As also mentioned above, the support assembly 18 includes adjustable coupling means 62 for adjustably coupling the support frame 56 to the mounting frame 54 for releasably securing the support frame 56 to the mounting frame 54 at the selected one angle of inclination. The coupling means 62 includes at least one and preferably a pair of elongated links 106 pivotally attached to the underside of the outer platform portion 100 of the support frame 56, and a pair of fastener elements 108 for receiving and clamping end portions of the respective links 106 for holding the support frame 56 at the one selected angle of inclination.

Figure 11:
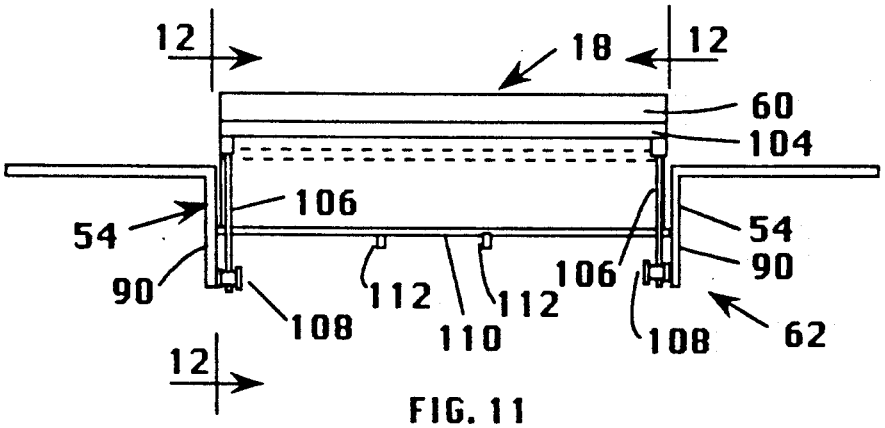
FIG. 11 is an end elevational view of the computer stand platform and the keyboard and forearm support assembly as seen along line 11—11 of FIG. 10.
Figure 12:
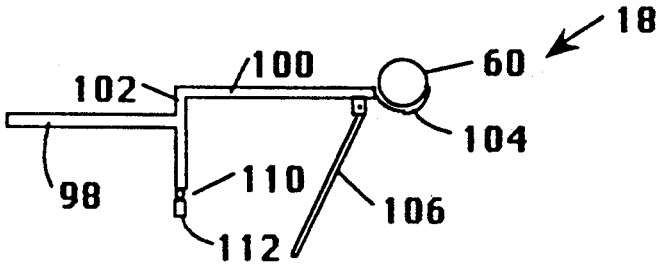
FIG. 12 is a side elevational view of a support frame of the keyboard and forearm support assembly as seen along line 12—12 of FIG. 11.
Figure 13:
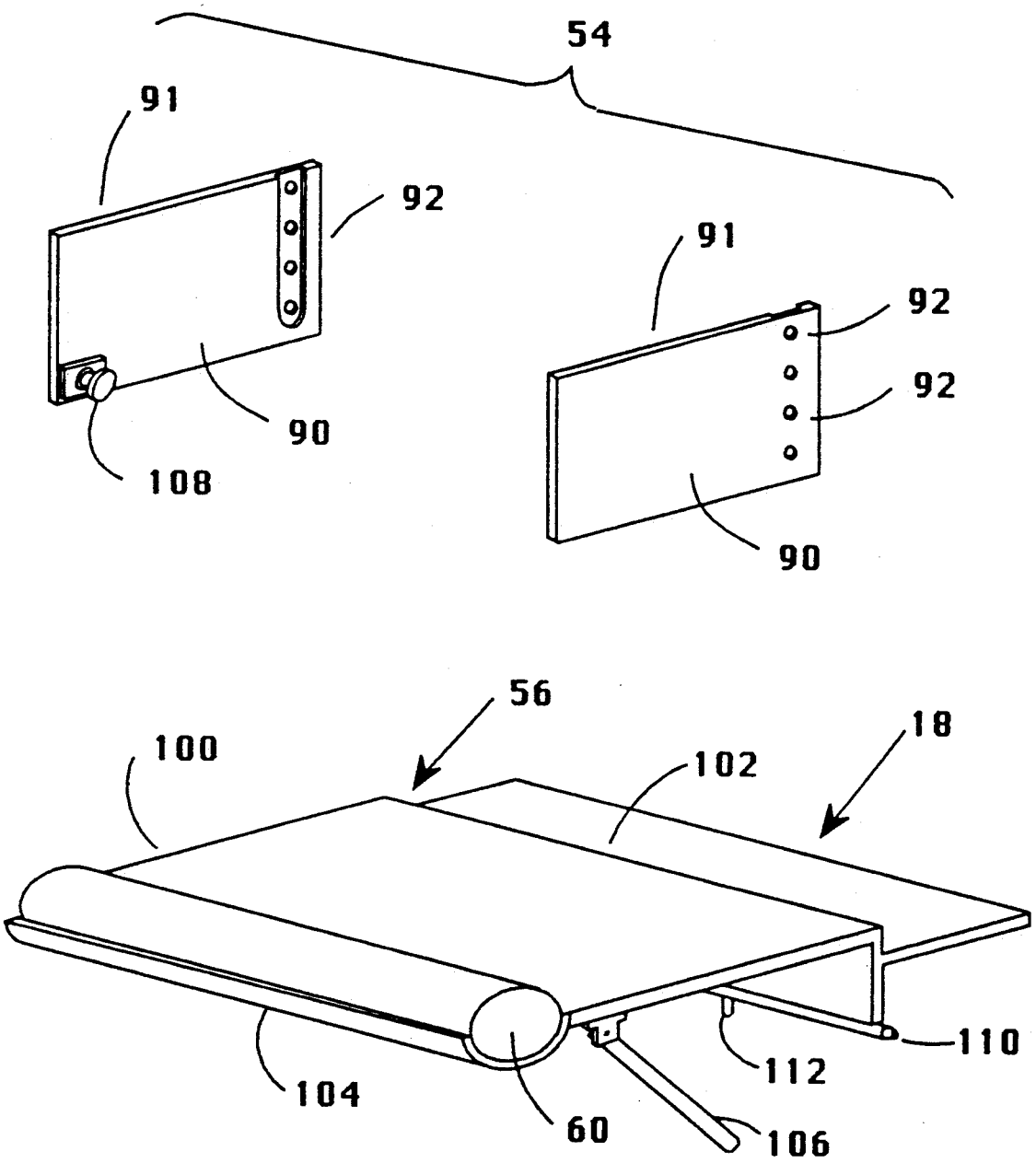
FIG. 13 is an enlarged perspective view of the keyboard and forearm support assembly.

The support frame 56 also includes an elongated hollow guide shaft 110 fixed along the lower edge of the middle wall 102 and defining a pivotal axis P of the support frame 56 relative to the mounting frame 54. A pair of shaft portions in the form of slidable rods 112 are mounted to the hollow guide shaft 110. The slidable rods 112 are biased for movement away from one another to extended positions in which their outer ends are inserted into a selected pair of the aligned holes 92 in the mounting frame plates 90, as seen in FIG. 11. The slidable rods 112 can be manually moved toward one another to retracted positions in which they are withdrawn from the aligned holes 92 and thereby permit adjustment of the support frame 56 to another selected one angular position, as shown in FIG. 11.

BENEFITS OF ERGONOMIC COMPUTER WORKSTATION

The combined effect of the many unique features of the ergonomic computer workstation 10 is to help relieve and ameliorate work-related physical problems encountered heretofore by permitting adjustment of the workstation to accommodate the requirements of different users in various sitting and standing positions. The workstation 10 will help users to continue working for longer periods without the necessity of taking breaks, as frequently as done heretofore, to relieve symptoms. Overall, the workstation should contribute to increase in user productivity and decrease in the incidence and cost of employee workman's compensation injuries.

With regard to neck pain and stiffness, the computer stand 12 and the keyboard and forearm support assembly 18 of the workstation 10 permits the computer keyboard 58 to be positioned at the proper level and the proper angle for each particular user to allow the user to assume a comfortable position and at the same time to change positions when necessary. The proper position for most individuals is a relaxed positioning of the cervical spine with the computer terminal screen at about eye level. The computer stand 12 and keyboard support assembly 18 accomplish this quite easily. Their position can also be easily changed to accommodate the needs of different individuals working on the same workstation regardless of their heights.

With regard to low back pain and stiffness, an individual can adjust the computer stand 12 and stool 14 to fit him or her for working in a sitting or standing position. The user can place one or the other foot on the adjustable footrest assembly 16, while either sitting or standing, for taking strain off the back and the lower extremities. The computer stand 12 and stool 14 easily adjust to accommodate an individual who is sitting to allow the knees, hips and back to be more comfortably and correctly placed in a more ergonomic posture, i.e. orthopedically proper posture, usually a 90 degree relationship at the knee, to relieve stress on the low back region.

With regard to the wrist and nerve problems, i.e., carpal tunnel syndrome about the wrist, the keyboard and forearm support assembly 18 includes a soft elbow support pad 60 for resting the elbows and has an offset region to permit positioning of the keyboard 58 in a position that allows the wrist to be maintained in a neutral, i.e. not dorsi or volar flexed, position. In other words, the wrist can be maintained in alignment with the forearm and not moved back away and flexed in a downward position causing strain on the wrist and quite possibly pressure in the median nerve. This over the long term would assist in preventing the development of carpal tunnel syndrome and alternately may allow someone with mild carpal tunnel symptoms to continue working.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. An ergonomically designed computer stand, comprising:

a base member for location in a stationary position on a supportive surface;

a movable vertical support member mounted on said base member adapted for movement in a generally vertical direction;

a platform supported by said movable vertical support member in a generally horizontal plane for supporting a computer thereon and adapted to move in a vertical direction together with said movable vertical support member;

a keyboard and computer user's forearm support assembly pivotably mounted to said platform for supporting a computer keyboard and the forearms of the computer user, said assembly being pivotably adjustable over a range of angles of inclination relative to the platform;

said support assembly comprising separate means to support a computer keyboard and means to support the entirety of a user's forearms, said means to support said keyboard comprising a first planar surface and said means to support said forearms comprising a second planar surface, said first and second planar surface each having a bottom and a top surface, said first and second planar surfaces connected by wall means so that said planar surfaces are offset with respect to one another such that said first planar surface is displaced in a different plane than said top surface of said top surface of said second planar surface to an extent such that said keyboard may be supported by said first planar surface in a manner such that planes formed by the keys of said keyboard and said top of said second planar surface are coplanar.

an elongated elbow stop positioned laterally along and extending upwardly from a portion of said second planar surface remote from said first planar surface; and means interconnecting said movable vertical support member and said base member and being selectively operable for moving said movable member vertically relative to said base member to position said platform at a desired elevation above the surface supporting said base member.

2. The stand of claim 1 wherein said base member includes:

a base portion for location in a generally horizontal stationary position on the supportive surface; and an upright channel rigidly mounted on said base portion and extending vertically in a generally orthogonal relation thereto.

3. The stand of claim 2 wherein said movable member includes:

an upright post slidably mounted vertically along said upright channel of said base member for movement in a generally vertical direction toward and away from said base portion of said base member.

4. The stand of claim 1 further comprising a footrest assembly which includes a footrest member and means to vertically move said footrest member in relation to said base member.

5. The stand of claim 4 wherein said means to vertically move said footrest member includes a ratchet mechanism interconnecting said footrest member and said base member.

6. The stand of claim 5 wherein said ratchet mechanism includes an upright guide track mounted to said base member and defining a plurality of generally vertically spaced latch portions.

7. The stand of claim 6 wherein said ratchet mechanism also includes a runner supporting said footrest member and slidably mounted to said guide track for generally vertical movement therealong.

* * * * *

UNITED STATES PATENT AND TRADEMARK OFFICE

CERTIFICATE OF CORRECTION

PATENT NO. : 5,174,223

DATED : December 29, 1992

INVENTOR(S) : MARTA K. NAGY ET AL.

It is certified that error appears in the above-identified patent and that said Letters Patent is hereby corrected as shown below:

Column 8, line 64:

In claim 1, line 29 of the claim, after "that", --said top surface of-- should be inserted; and, Column 8, line 65, line 30 of the claim, after "said top surface of" (first occurrence), "said top surface of" should be deleted.

Signed and Sealed this

Nineteenth Day of October, 1993

*Attest:*

*Attesting Officer*

BRUCE LEHMAN

*Commissioner of Patents and Trademarks*